United States Patent [19]

Georget et al.

[11] 4,181,266

[45] Jan. 1, 1980

[54] PNEUMATICALLY ASSISTED MAINTAINING AND SETTING SYSTEMS FOR THE JAW-PLATE OF A JAW CRUSHER

[75] Inventors: Jean-Pierre Georget, Denain; Guy Dolèans, Aulnoy les Valenciennes, both of France

[73] Assignee: Fives-Cail Babcock, Paris, France

[21] Appl. No.: 864,710

[22] Filed: Dec. 27, 1977

[30] Foreign Application Priority Data

Dec. 24, 1976 [FR] France ..... 76 39032

[51] Int. Cl.[2] ..... B02C 1/04

[52] U.S. Cl. ..... 241/264; 241/300

[58] Field of Search ..... 241/231, 262, 264–269, 241/300; 267/118, 122

[56] References Cited

U.S. PATENT DOCUMENTS

| | | | |
|---|---|---|---|
| 1,309,807 | 7/1919 | Newhouse | 241/300 X |
| 2,532,678 | 12/1950 | Shelton | 241/269 X |
| 2,828,925 | 4/1958 | Rumpel | 241/300 X |
| 3,153,512 | 10/1964 | Polzin | 241/300 |
| 3,166,259 | 1/1965 | Archer et al. | 241/267 X |
| 3,315,902 | 4/1967 | Pollitz | 241/231 |
| 3,804,345 | 4/1974 | De Diemar | 241/300 X |
| 3,976,255 | 8/1976 | Edwards | 241/264 |

FOREIGN PATENT DOCUMENTS

| | | | |
|---|---|---|---|
| 841379 | 6/1952 | Fed. Rep. of Germany | 267/122 |

*Primary Examiner*—Howard N. Goldberg
*Attorney, Agent, or Firm*—Kurt Kelman

[57] ABSTRACT

In a jaw crusher, pneumatically assisted systems for maintaining the jaw-plate of the crusher on its carrier and for setting the position of the carrier and the jaw-plate mounted thereon.

10 Claims, 6 Drawing Figures

Figure 1:
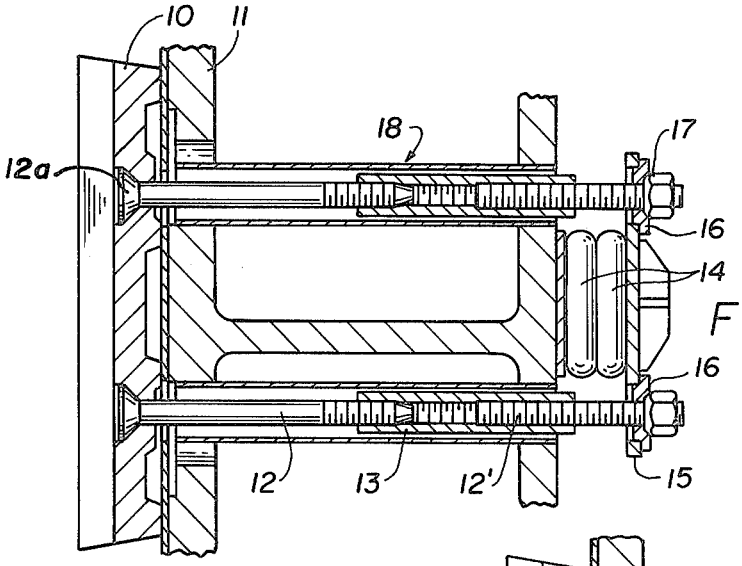

PNEUMATICALLY ASSISTED MAINTAINING AND SETTING SYSTEMS FOR THE JAW-PLATE OF A JAW CRUSHER

The present invention relates to improvements in jaw crushers and, more particularly, in systems for maintaining and dismounting the jaw-plate of the crusher on its carrier and for setting the position of the carrier and the jaw-plate mounted thereon.

As is well known, jaw crushers comprise a frame having two side plates and respective crossbeams in the front and rear extending therebetween and affixed thereto, one of the crossbeams supporting a stationary jaw-plate carrier and the other crossbeam supporting a mobile jaw-plate carrier for swinging movement on the frame, the jaw-plates on the carriers defining a gap therebetween wherein material may be crushed by the swinging movement of the mobile jaw-plate carrier with respect to the stationary jaw-plate carrier. Normally, the system for maintaining the jaw-plate on the carrier includes locking bolt and nut means detachably maintaining the jaw-plate on the carrier. It has been proposed to include in this maintaining system spring means interposed between the rear face of the carrier and the nut means for maintaining the jaw-plate on the carrier under yieldable pressure or, for the same purpose, to replace the bolt means by hydraulic traction jacks. The jaw-plate is dismounted from the carrier by a mechanism which moves the jaw-plate away from the carrier. The system for setting the position of the carrier includes a slide block mounted on the crossbeam, a toggle supporting the carrier on the slide block and a tension means connecting the carrier to the crossbeam. The slide block is movable along two support surfaces which enclose an angle with each other and setting of the carrier position is effected by interposing wedges of different thicknesses between the support surfaces and the slide block so as to displace the slide block in a horizontal and vertical direction. The tension means is under spring pressure. Various spring and/or hydraulic pressure means have been proposed for exerting a yieldably pressure between the slide block and its support surfaces to enable wedges to be removed or added between the support surfaces and the slide block.

These known systems have a number of disadvantages. They require extended and difficult manual handling. The vibrations to which they are subjected during operation of the crusher cause rapid wear of many mechanical parts. For example, in the case of the jaw-plates, the locking bolts tend to lose their tension, bringing about or increasing warpage of the metal jaw-plates and causing jamming of the entire assembly, thus making their dismounting from the carriers when replacement is required difficult. Hydraulic jacks used for this purpose cause serious problems of space, and it is difficult to maintain their fluid-tightness, due to the dusty environment in which they operate in a jaw crusher.

It is the primary object of this invention to overcome these and other disadvantages and to facilitate the mounting and dismounting of the jaw-plates on and from their carriers, as well as parts of the setting system.

This and other objects are accomplished in accordance with the invention in a jaw crusher of the above-described type by providing in at least one of the systems a pneumatic means operable to keep the respective system operative. When the pneumatic means is under air pressure, it maintains the locking bolt and nut means under pressure whereby the jaw-plate is maintained on the carrier, and it maintains the slide block in position to set the position of the carrier. When the pneumatic means is deflated, the jaw-plate may be readily dismounted and the slide block may be repositioned. While reducing the number of mechanical parts, the pneumatic means, which consists of air-filled cushions, exerts a constant and yieldable pressure. Mounting, dismounting and setting operations may be readily initiated simply by deflating the air-filled cushions so as to remove the pressure, and the jaw-plate or the sliding block may then be readily displaced by small jacks used only during these operations and not exposed to the dust during operation of the jaw crusher.

Figure 2:
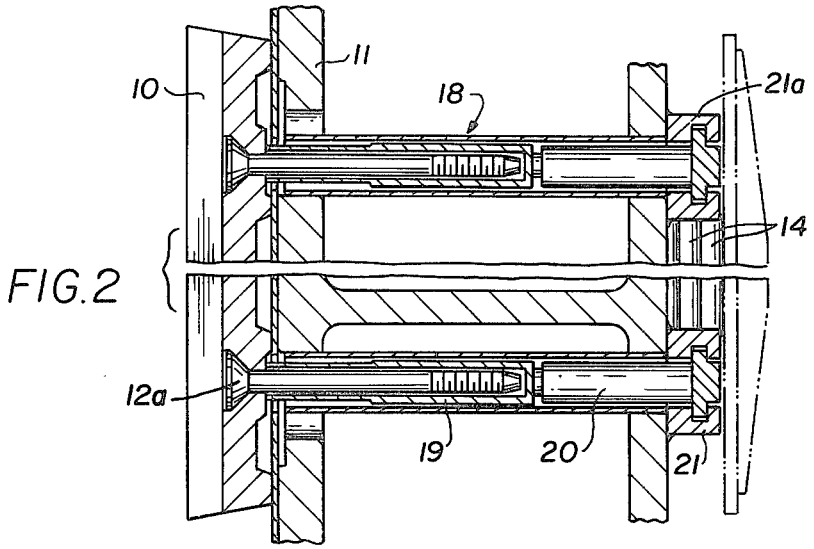
Figure 3:
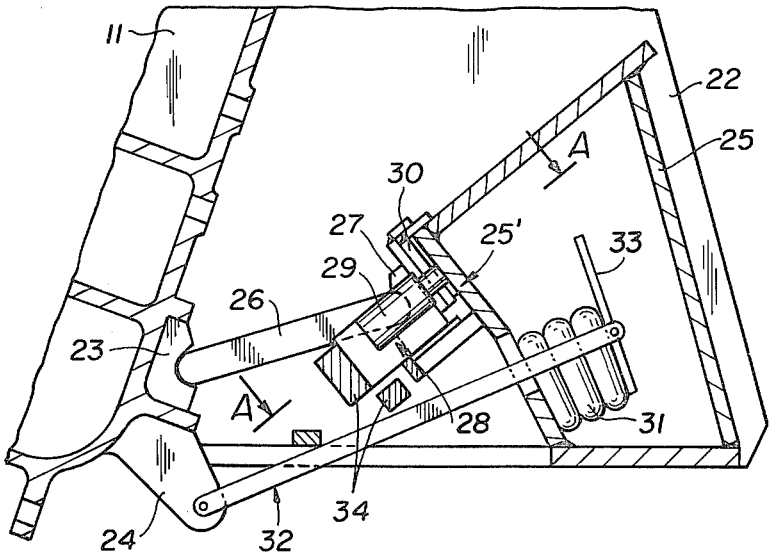
Figure 4:
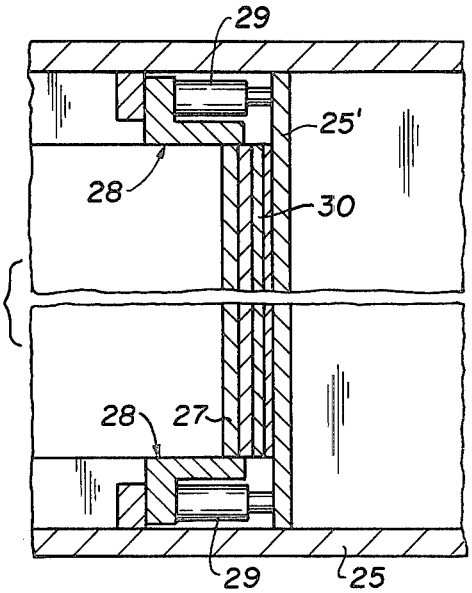
Figure 5:
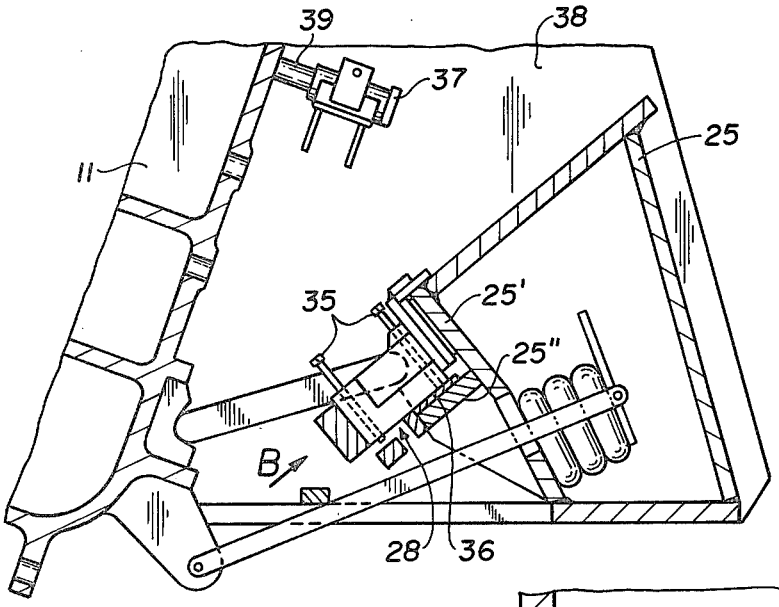
Figure 6:
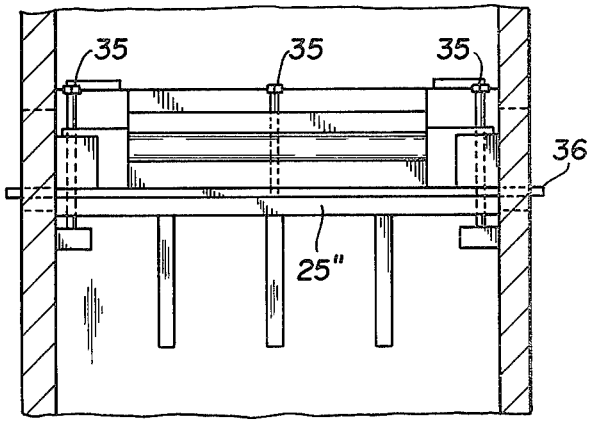

The above and other objects, advantages and features of the present invention will become more apparent from the following detailed description of a now preferred embodiment thereof, taken in conjunction with the accompanying drawing wherein FIG. 1 is a vertical section of a portion of the jaw crusher, showing the jaw-plate maintaining system schematically, FIG. 2 is the same view, the system being illustrated with jaw-plate dismounting means, FIG. 3 is a schematic vertical section of the setting system, FIG. 4 is a section along line A—A of FIG. 3, FIG. 5 is a sectional view analogous to that of FIG. 3, and FIG. 6 is an end view in the direction of arrow B of FIG. 5.

Referring now to the drawing and first to FIG. 1, there is shown only a portion of one jaw-plate 10 of a jaw crusher, the jaw-plate being affixed to jaw-plate carrier 11 by a two-part bolt 12, 12', the two parts 12 and 12' of the bolt being threadedly assembled in internally threaded sleeve 13. Tubular guide 18 in carrier 11 holds the locking bolt-and-sleeve assembly in position and has a diameter exceeding that of the bolt so as to define an annular space therebetween. An air-filled cushion 14 is sandwiched between the rear face of carrier 11 and a support plate positioned substantially parallel to the rear face of the carrier and spaced therefrom. While the heads **12*a* of bolt parts 12 engage jaw-plate 10 to press it against carrier 11 when this bolt part is screwed into threaded sleeve 13, nuts 17 are threadedly engaged with the outer threaded ends of bolt parts 12' whose inner ends are screwed into threaded sleeve 13, bolt parts 12' extending through holes in support plate 15 and nuts 17 pressing against washers 16** mounted in the holes. In this manner, the jaw-plate is maintained under pneumatic pressure on its carrier.

When it is desired to dismount jaw-plate 10, the air is let out of cushion 14 to relieve the pressure, and nuts 17, with bolt parts 12' and threaded sleeve 13 are removed. As shown in FIG. 2, sleeve 19 is then introduced into each partially empty tubular guide 18 and this sleeve is moved over bolt part 12 until it abuts the rear face of jaw-plate 10. Hydraulic jack 20 is then introduced into the tubular guide and is held in position against axial outward movement by abutments 21 placed into seats **21*a* provided on carrier 11. This jaw-plate dismounting means is actuated by applying hydraulic pressure to the piston of jack 20, thus moving jaw-plate 10 away from the front face of carrier 11**.

FIG. 3 shows the lower portion of mobile carrier 11 for the swing jaw of the crusher, which cooperates with a fixed crusher jaw (not shown) in an otherwise conventional manner, material being fed into a gap defined between the jaws and being crushed therebetween by the movement of the swing jaw. Since such jaw crushers are well known and this invention is not concerned with their general structure, the drawing and description has been limited to those structural portions relevant thereto. As indicated in FIG. 3, at the lower end of carrier 11, the rear face thereof defines support seat 23 and has a bracket 24 to enable a setting system to secure the mobile jaw-plate carrier to cross-beam 25 affixed to said plate 22 of the crusher frame. The setting system comprises toggle 26 one of whose ends is articulated in seat 23 and whose other end is articulated in a seat in slide block 27 which, in turn, may be supported directly on crossbeam 25 or, as illustrated, by interposed wedges 30.

As appears more clearly from FIG. 4, each end of the slide block has a seat 28 defining a space for accommodating a hydraulic jack 29, one end of each jack abutting seat 28 while its other end abuts a support plate 25' of crossbeam 25. The support plate forms the rear support for slide block 27 and wedges 30 are interposed between the slide block and this support plate. When hydraulic pressure is applied to the pistons of jacks 29, the slide block is moved away from the crossbeam and thus permits wedges to be added or removed, thereby setting the slide block in a desired horizontal position.

The illustrated setting system for the swing jaw further includes tension rod 32 whose one end is connected to bracket 24 at the lower end of swing jaw-plate carrier 11 while its other end is connected to plate 33 affixed to crossbeam 25, the tension rod passing through an opening in support plate 25' to enable the tension rod to move with mobile carrier 11 when the swing jaw is oscillated during operation of the crusher. Air-filled cushion 31 is positioned between support plate 25' and plate 33 of crossbeam 25 and, when inflated, applies a tension force to the connection between carrier 11 and crossbeam 25. When slide block 27 is to be set in a desired horizontal position by the addition or removal of wedges 30, air cushion 31 is deflated to release the tension force. Abutments 34 delimit the path of displacement of slide block 27. To avoid redundancy, the same reference numerals designate the same parts in FIGS. 5 and 6, some of these reference numerals having been eliminated to clarify the illustration. As has been indicated in these figures, the slide block may be set in a desired vertical position by means of a mechanism which includes jack bolts 35 which hold slide block 27 on lower support plate 25'' which is affixed to support plate 25' of crossbeam 25, the respective support plates providing a runway for the slide block in mutually perpendicular directions. By loosening bolts 35, it is possible to add or remove wedges 36 between slide block 27 and lower support plate 25'' whereby the vertical position of the slide block may be changed.

Toggle 26 may be dismounted by a mechanism for displacing swing jaw-plate carrier 11 away from the toggle so as to free the adjacent end of the toggle from its seat 23, thereby making it possible to lift the toggle out of the assembly. This mechanism includes in the illustrated embodiment a hydraulic jack 39 accommodated in seat 37 affixed to crusher frame 38 which comprises two side plates wherebetween crossbeam 25 extends and to which it is affixed to constitute the lower support for jaw-plate carrier 11. When hydraulic pressure is applied to the piston of jack 39, it pushes carrier 11 leftwards, as seen in FIG. 5, thus disengaging seat 23 from the end of toggle 26.

The pneumatically assisted systems for maintaining the crusher jaw on its carrier and for setting the swing jaw in desired positions according to the invention simplifies the operations for assembling and dismounting the operating parts, and considerably shortens the downtime when, because of wear or breakage, it is necessary to replace the jaw-plate, the toggle or other parts used in the setting of the swing jaw.

While the present invention has been described in connection with a single toggle jaw crusher of otherwise conventional structure, it may be used in connection with all types of jaw crushers. The position of the air-filled cushions may differ, as may that of the seats for the jacks, depending on the specific setting and maintaining systems for the jaw of the crusher.

I claim:

1. A jaw crusher which comprises a frame having two side plates and a crossbeam extending therebetween and affixed thereto, a jaw-plate carrier supported for swinging movement on the frame, a jaw-plate replaceably mounted on the carrier, a system for maintaining the jaw-plate on the carrier, a system for setting the position of the carrier and the jaw-plate mounted thereon, the setting system including a slide block adjustably mounted on the crossbeam and a toggle connecting the carrier to the crossbeam, the jaw-plate maintaining system comprising resilient tension means pressing the jaw-plate against the carrier and means for moving the jaw-plate away from the carrier for enabling the replacement of the jaw-plate on the carrier, and the setting system comprising resilient tension means pressing the slide block against the crossbeam and means for moving the slide block away from the crossbeam for enabling the adjustment of the slide block on the crossbeam, at least one of the systems comprising a deflatable air-filled cushion means incorporated in the resilient tension means and the moving means in the one system comprising the deflatable air-filled cushion means being operable after deflation of the cushion means.

2. The jaw crusher of claim 1, wherein the resilient tension means of the setting system comprises a tension rod having two ends, one end being connected to the carrier, and further comprising two support surfaces for the slide block on the crossbeam and a support plate to which the other end of the tension rod is connected, the air-filled cushion means being disposed between the support plate and the crossbeam.

3. The jaw crusher of claim 2, wherein the slide block has seats at respective ends thereof, and the moving means of the setting system comprises a respective jack having one end received in a respective one of the seats, actuation of the jacks pushing the slide block away from said surfaces of the crossbeam upon deflatable of the cushion means.

4. The jaw crusher of claim 3, comprising replaceable wedge means disposed between the support surfaces and the slide block.

5. The jaw crusher of claim 1, further comprising respective seats on the side plates of the frame and a respective jack supported in a respective one of the seats and bearing against the carrier for displacing the carrier with respect to the frame.

6. The jaw crusher of claim 5, wherein the moving means of the jaw-plate maintaining system comprises a jack means having two ends, the jaw-plate having a seat receiving one of the jack means ends and the other jack means end taking abutment on the carrier for pushing away the jaw-plate from the carrier on actuation of the jack means.

7. The jaw crusher of claim 6, wherein the resilient tension means of the maintaining system comprises bolt means having one end in engagement with the jaw-plate and another end projecting beyond a rear face of the carrier, a support plate spaced from the rear face of the carrier and defines openings through which the other end of the bolt means projects, nut means threadedly mounted on the other end of the bolt means projecting through the openings of the support plate, and the air-filled cushion means is disposed between the rear face of the carrier and the support plate.

8. The jaw crusher of claim 7, comprising a tubular guide for the bolt means extending through the carrier, the tubular guide having a diameter exceeding that of the bolt means.

9. The jaw crusher of claim 8, wherein the bolt means comprises two bolt parts and an internally threaded sleeve detachably interconnecting the two bolt parts, one of the bolt parts having the one end in engagement with the jaw-plate, and detachment of the threaded sleeve and the other bolt part from the one bolt part leaving an axially extending space and an annular space surrounding the one bolt part in the tubular guide, the axially extending space constituting the seat, and further comprising a sleeve received in the tubular guide and extending in the annular space to the jaw-plate, and abutment means mounted on the rear face of the carrier, the sleeve being received in the tubular guide and the abutment means being mounted on the rear face of the carrier upon the detachment of the threaded sleeve and the other bolt part, and the jack means for the maintaining system consisting of a hydraulic jack mounted in the axially extending space in respective abutment against the sleeve and the abutment means whereby acutation of the jack pushes the jaw-plate away from the carrier.

10. The jaw crusher of claim 9, comprising a seat means on the rear face of the carrier for receiving the abutment means.

* * * * *